US007003452B1

(12) United States Patent
Lubiarz et al.

(10) Patent No.: US 7,003,452 B1
(45) Date of Patent: Feb. 21, 2006

(54) METHOD AND DEVICE FOR DETECTING VOICE ACTIVITY

(75) Inventors: Stéphane Lubiarz, Paris (FR); Edouard Hinard, Paris (FR); François Capman, Versailles (FR); Philip Lockwood, Vaureal (FR)

(73) Assignee: Matra Nortel Communications, Quimper (FR)

( * ) Notice: Subject to any disclaimer, the term of this patent is extended or adjusted under 35 U.S.C. 154(b) by 641 days.

(21) Appl. No.: 09/806,756

(22) PCT Filed: Aug. 2, 2000

(86) PCT No.: PCT/FR00/02220

§ 371 (c)(1),
(2), (4) Date: May 3, 2001

(87) PCT Pub. No.: WO01/11605

PCT Pub. Date: Feb. 15, 2001

(30) Foreign Application Priority Data

Aug. 4, 1999 (FR) ..... 99 10128

(51) Int. Cl.
*G10L 11/02* (2006.01)

(52) U.S. Cl. ..... 704/210; 704/226

(58) Field of Classification Search ..... 704/205, 704/206, 210, 215, 226, 227, 233; 381/94.1, 381/94.2, 94.7
See application file for complete search history.

(56) References Cited

U.S. PATENT DOCUMENTS

| | | | | |
|---|---|---|---|---|
| 4,682,361 | A * | 7/1987 | Selbach et al. | 704/233 |
| 4,982,341 | A * | 1/1991 | Laurent | 704/250 |
| 6,427,134 | B1 * | 7/2002 | Garner et al. | 704/233 |
| 6,453,285 | B1 * | 9/2002 | Anderson et al. | 704/210 |
| 6,453,289 | B1 * | 9/2002 | Ertem et al. | 704/225 |
| 6,453,291 | B1 * | 9/2002 | Ashley | 704/233 |
| 6,477,489 | B1 * | 11/2002 | Lockwood et al. | 704/200.1 |
| 6,549,586 | B1 * | 4/2003 | Gustafsson et al. | 375/285 |
| 6,591,234 | B1 * | 7/2003 | Chandran et al. | 704/225 |
| 6,604,071 | B1 * | 8/2003 | Cox et al. | 704/225 |
| 6,658,380 | B1 * | 12/2003 | Lockwood et al. | 704/215 |
| 6,717,991 | B1 * | 4/2004 | Gustafsson et al. | 375/285 |

FOREIGN PATENT DOCUMENTS

WO WO 99/14737 * 3/1999

* cited by examiner

*Primary Examiner*—Martin Lerner
(74) *Attorney, Agent, or Firm*—Trop, Pruner & Hu, PC

(57) ABSTRACT

The invention concerns a method for detecting voice activity in a digital speech signal, in at least a frequency band, for example by means of a detecting automaton whereof the status is controlled on the basis of an energy analysis of the signal. The control of said automaton, or more generally the determination of voice activity, comprises a comparison, in the frequency band, of two different versions of the speech signal one of which at least is a noise-corrected version.

30 Claims, 5 Drawing Sheets

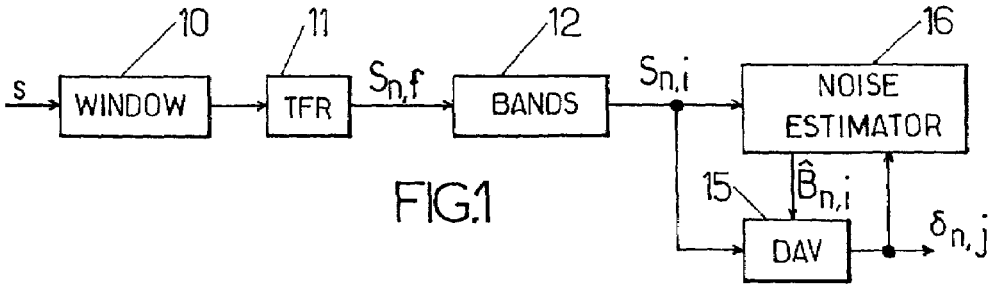
FIG.1
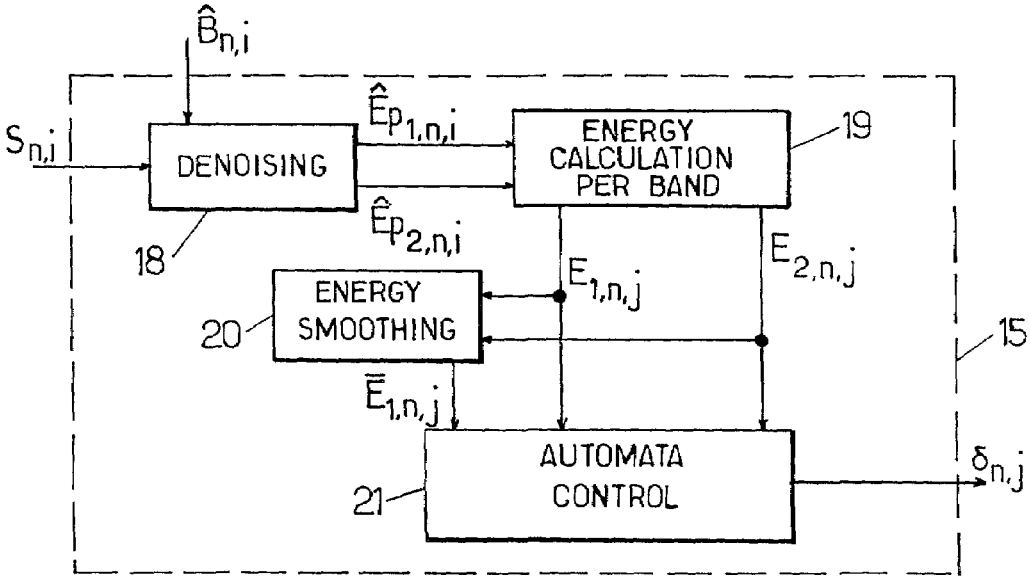
FIG.2
FIG.7
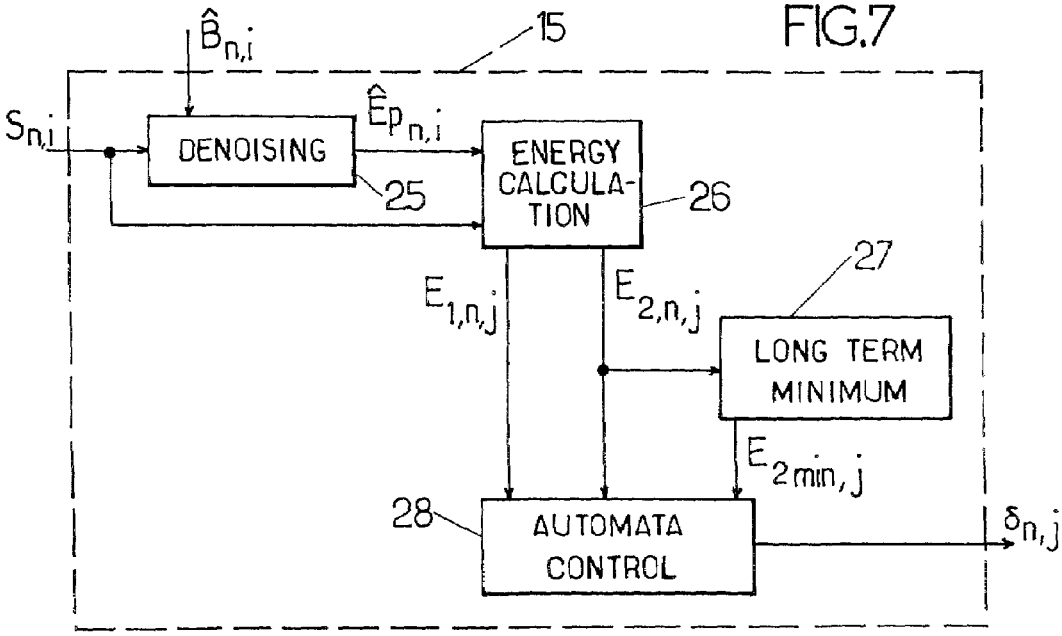

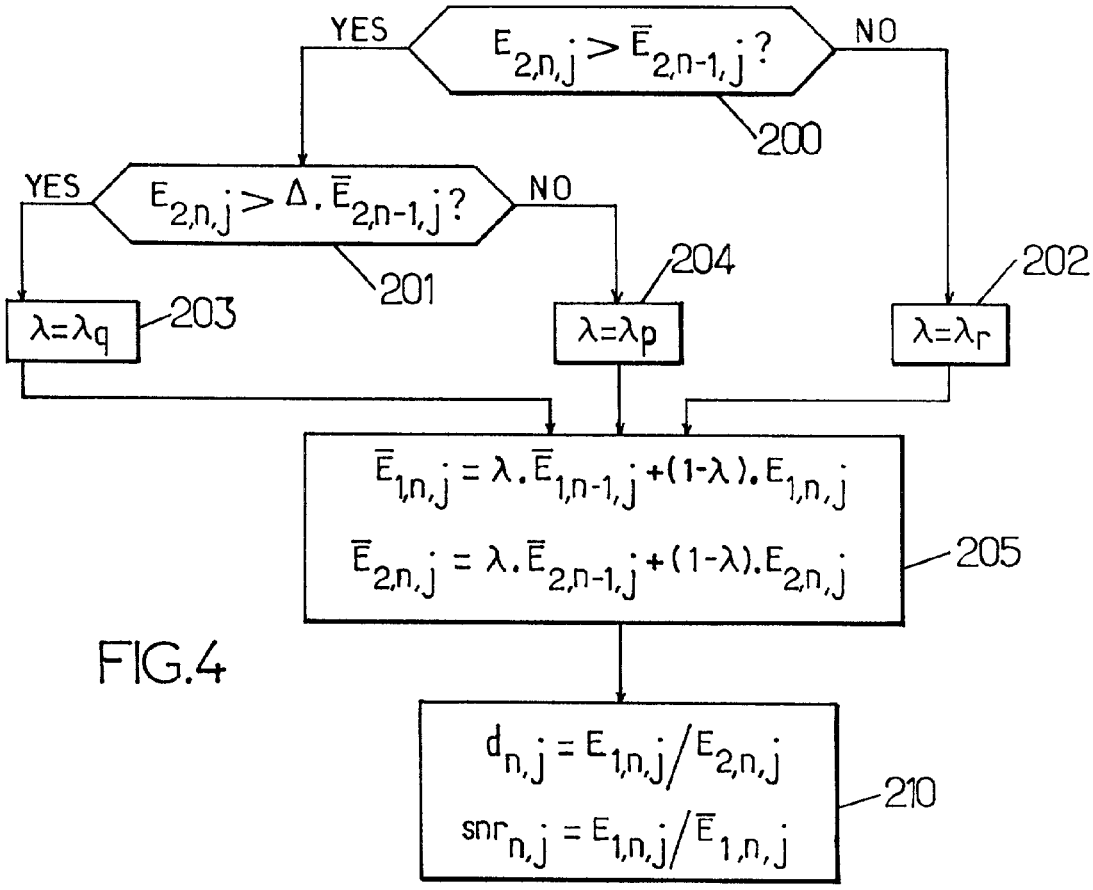
FIG.4
FIG.6
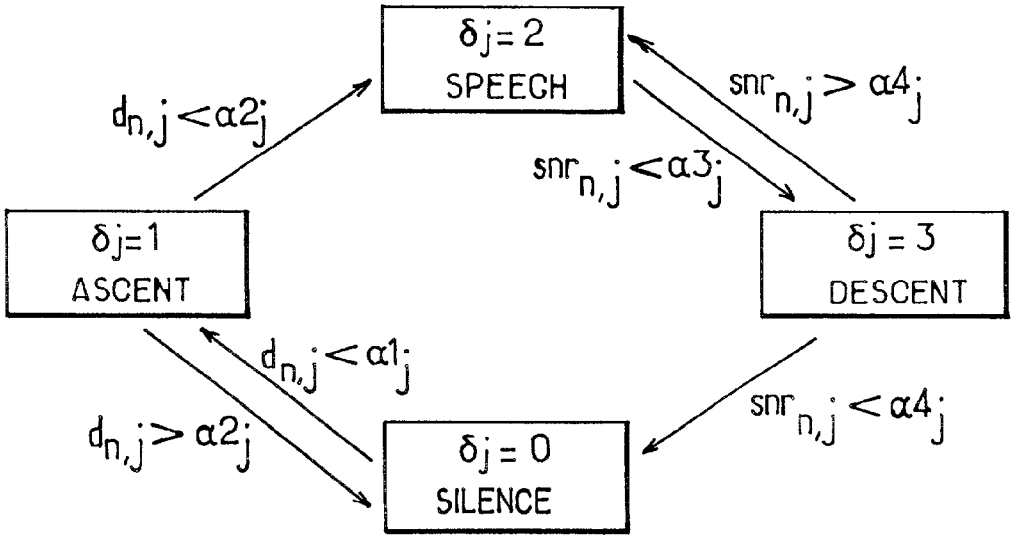

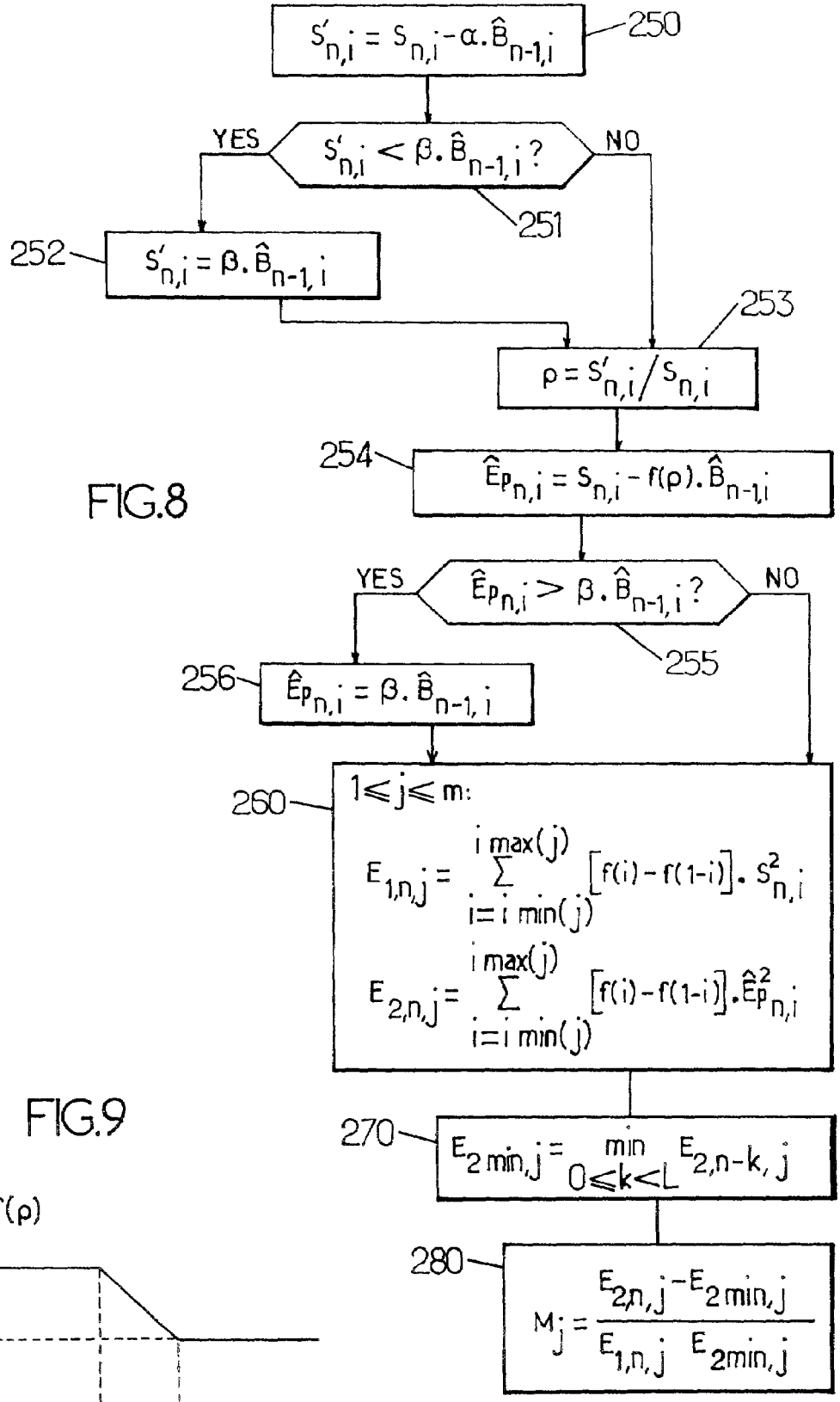
FIG.8
FIG.9
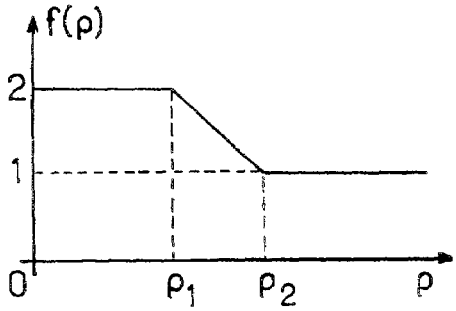

METHOD AND DEVICE FOR DETECTING VOICE ACTIVITY

BACKGROUND OF THE INVENTION

The present invention relates to digital techniques for processing speech signals. It relates more particularly to the techniques utilizing voice activity detection so as to perform different processings depending on whether the signal does or does not carry voice activity.

The digital techniques in question come under varied domains: coding of speech for transmission or storage, speech recognition, noise reduction, echo cancellation, etc.

The main difficulty with processes for detecting voice activity is that of distinguishing between voice activity and the noise which accompanies the speech signal.

The document WO99/14737 describes a method of detecting voice activity in a digital speech signal processed on the basis of successive frames and in which an a priori denoising of the speech signal of each frame is carried out on the basis of noise estimates obtained during the processing of one or more previous frames, and the variations in the energy of the a priori denoised signal are analyzed so as to detect a degree of voice activity of the frame. By carrying out the detection of voice activity on the basis of an a priori denoised signal, the performance of this detection is substantially improved when the surrounding noise is relatively strong.

In the methods customarily used to detect voice activity, the energy variations of the (direct or denoised) signal are analyzed with respect to a long-term average of the energy of this signal, a relative increase in the instantaneous energy suggesting the appearance of voice activity.

An aim of the present invention is to propose another type of analysis allowing voice activity detection which is robust to the noise which may accompany the speech signal.

SUMMARY OF THE INVENTION

According to the invention, there is proposed a method for detecting voice activity in a digital speech signal in at least one frequency band, whereby the voice activity is detected on the basis of an analysis comprising a comparison, in the said frequency band, of two different versions of the speech signal, one at least of which is a denoised version obtained by taking account of estimates of the noise included in the signal.

This method can be executed over the entire frequency band of the signal, or on a subband basis, as a function of the requirements of the application using voice activity detection.

Voice activity can be detected in a binary manner for each band, or measured by a continuously varying parameter which may result from the comparison between the two different versions of the speech signal.

The comparison typically pertains to respective energies, evaluated in the said frequency band, of the two different versions of the speech signal, or to a monotonic function of these energies.

Another aspect of the present invention relates to a device for detecting voice activity in a speech signal, comprising signal processing means designed to implement a method as defined hereinabove.

The invention further relates to a computer program, loadable into a memory associated with a processor, and comprising portions of code for implementing a method as defined hereinabove upon the execution of the said program by the processor, as well as to a computer medium, on which such a program is recorded.

BRIEF DESCRIPTION OF THE DRAWINGS

FIG. 1 is a schematic diagram of a signal processing chain using a voice activity detector according to the invention;

FIG. 2 is a schematic diagram of an exemplary voice activity detector according to the invention;

FIGS. 3 and 4 are flow charts of signal processing operations performed in the detector of FIG. 2;

FIG. 6 is a diagram of a detection automaton implemented in the detector of FIG. 2;

FIG. 7 is a schematic diagram of another embodiment of a voice activity detector according to the invention;

FIG. 8 is a flow chart of signal processing operations performed in the detector of FIG. 7;

FIG. 9 is a graphic of a function used in the operations of FIG. 8.

DETAILED DESCRIPTION

Figure 3:
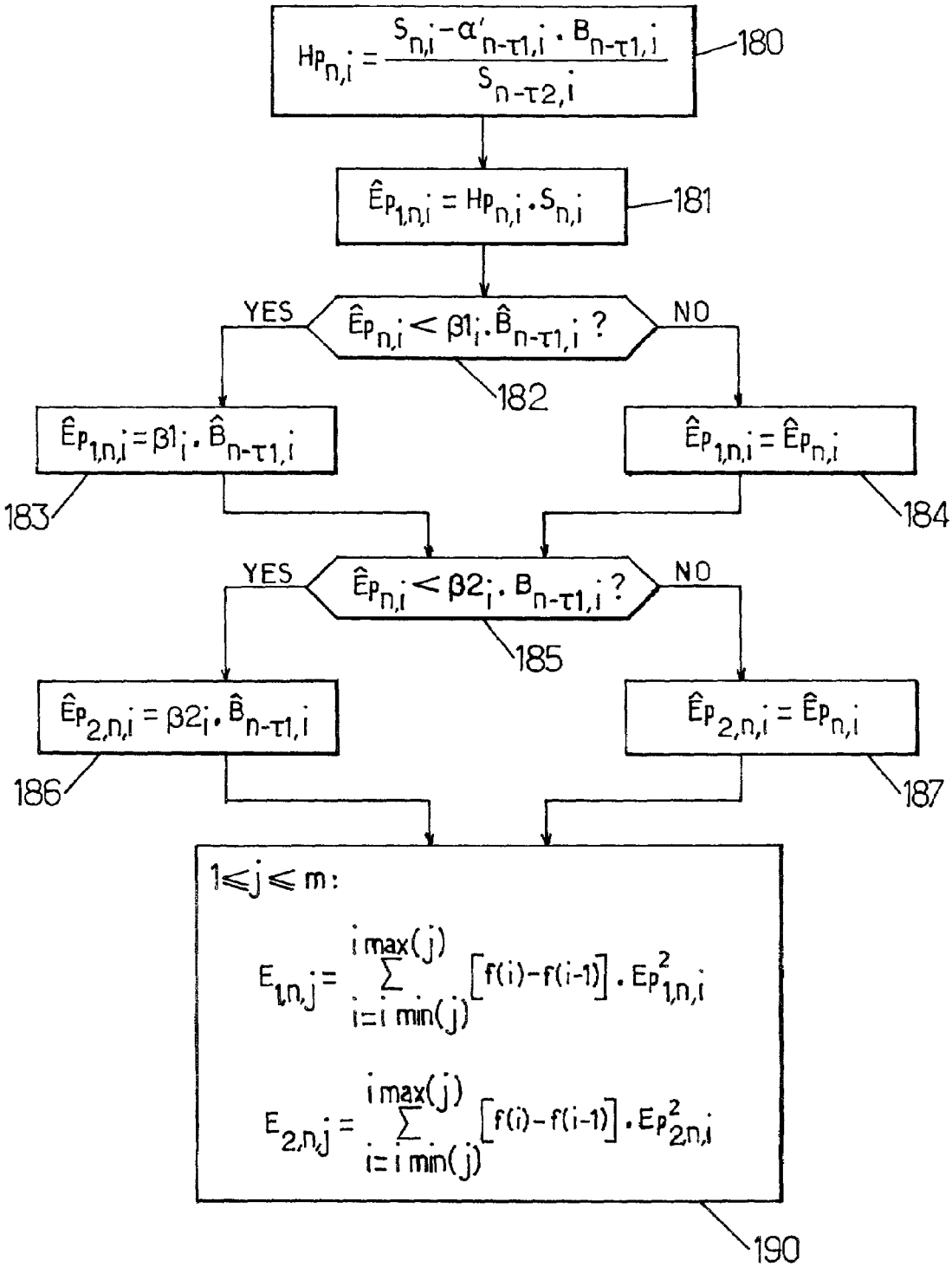

The device of FIG. 1 processes a digital speech signal s. The signal processing chain represented produces voice activity decisions $\delta_{n,j}$ which are usable in a manner known per se by application units, not represented, affording functions such as speech coding, speech recognition, noise reduction, echo cancellation, etc. The decisions $\delta_{n,j}$ can comprise a frequency resolution (index j), this making it possible to enhance applications operating in the frequency domain.

A windowing module 10 puts the signal s into the form of successive windows or frames of index n, each consisting of a number N of samples of digital signal. In a conventional manner, these frames may exhibit mutual overlaps. In the remainder of the present description, the frames will be regarded, without this being in any way limiting, as consisting of N=256 samples at a sampling frequency $F_e$ of 8 kHz, with a Hamming weighting in each window, and overlaps of 50% between consecutive windows.

The signal frame is transformed into the frequency domain by a module 11 applying a conventional fast Fourier transform algorithm (FFT) for calculating the modulus of the spectrum of the signal. The module 11 then delivers a set of N=256 frequency components of the speech signal, which are denoted $S_{n,f}$, where n designates the current frame number, and f a frequency of the discrete spectrum. Owing to the properties of digital signals in the frequency domain, only the first N/2=128 samples are used.

To calculate the estimates of the noise contained in the signal s, we do not use the frequency resolution available at the output of the fast Fourier transform, but a lower resolution, determined by a number I of frequency subbands covering the $[0,F_e/2]$ band of the signal. Each subband i ($1 \leqq i \leqq I$) extends between a lower frequency f(i−1) and an upper frequency f(i), with f(0)=0, and $f(I)=F_e/2$. This chopping into subbands can be uniform ($f(i)-f(i-1)=F_e/2I$). It may also be non-uniform (for example according to a barks scale). A module 12 calculates the respective averages of the spectral components $S_{n,f}$ of the speech signal on a subband basis, for example through a uniform weighting such as:

$$S_{n,i} = \frac{1}{f(i) - f(i-1)} \sum_{f \in [f(i-1), f(i)]} S_{n,f}$$

This averaging reduces the fluctuations between the subbands by averaging the contributions of the noise in these subbands, and this will reduce the variance of the noise estimator. Furthermore, this averaging makes it possible to reduce the complexity of the system.

The averaged spectral components $S_{n,i}$ are addressed to a voice activity detection module 15 and to a noise estimation module 16. $\hat{B}_{n,i}$ denotes the long-term estimate of the noise component produced by the module 16 in relation to frame n and to subband i.

These long-term estimates $\hat{B}_{n,i}$ may for example be obtained in the manner described in WO99/14737. It is also possible to use simple smoothing by means of an exponential window defined by a forget factor $\lambda_B$:

$$\hat{B}_{n,i} = \lambda_B . \hat{B}_{n-1,i} + (1-\lambda_B) . S_{n,i}$$

with $\lambda_B$ equal to 1 if the voice activity detector 15 indicates that subband i bears voice activity, and equal to a value lying between 0 and 1 otherwise.

Of course, it is possible to use other long-term estimates representative of the noise component included in the speech signal, these estimates may represent a long-term average, or else a minimum of the component $S_{n,j}$ over a sufficiently long sliding window.

FIGS. 2 to 6 illustrate a first embodiment of the voice activity detector 15. A denoising module 18 executes, for each frame n and each subband i, the operations corresponding to steps 180 to 187 of FIG. 3, so as to produce two denoised versions $\hat{E}p_{1,n,i}$, $\hat{E}p_{2,n,i}$ of the speech signal. This denoising is done by non-linear spectral subtraction. The first version $\hat{E}p_{1,n,i}$, is denoised in such a way as not to be less, in the spectral domain, than a fraction $\beta 1_i$ of the long-term estimate $\hat{B}_{n-\tau,i}$. The second version $\hat{E}p_{2,n,i}$ is denoised in such a way as not to be less, in the spectral domain, than a fraction $\beta 2_j$ of the long-term estimate $\hat{B}_{n-\tau 1,i}$. The quantity $\tau 1$ is a delay expressed as a number of frames, which may be fixed (for example $\tau 1=1$) or variable. The more confident one is in the voice activity detection, the smaller the delay will be. The fractions $\beta 1_i$ and $\beta 2_i$ (such that $\beta 1_i > \beta 2_i$) may be dependent on or independent of subband i. Preferred values correspond for $\beta 1_i$ to an attenuation of 10 dB, and for $\beta 2_i$ to an attenuation of 60 dB, i.e. $\beta 1_i \approx 0.3$ and $\beta 2_i \approx 0.001$.

In step 180, the module 18 calculates, with the resolution of the subbands i, the frequency response $Hp_{n,i}$ of the a priori denoising-filter, according to:

$$Hp_{n,j} = \frac{S_{n,i} - \alpha'_{n-\tau 1,i} \cdot \hat{B}_{n-\tau 1,i}}{S_{n-\tau 2,i}}$$

where $\tau 2$ is a positive or zero integer delay and $\alpha'_{n,i}$ is a noise overestimation coefficient. This overestimation coefficient $\alpha'_{n,i}$ may be dependent on or independent of the frame index n and/or the subband index i. In a preferred embodiment, it depends both on n and i, and it is determined as described in document WO99/14737. A first denoising is performed in step 181: $\hat{E}p_{n,i} = Hp_{n,i} . S_{n,i}$. In steps 182 to 184, the spectral components $\hat{E}p_{1,n,i}$ are calculated according $\hat{E}p_{1,n,i} = \max(\hat{E}p_{n,i} : \beta 1_i . \hat{B}_{n-\tau 1,i})$, and in steps 185 to 187, the spectral components $\hat{E}p_{2,n,i}$ are calculated according to $\hat{E}p_{2,n,i} = \max(\hat{E}p_{n,i} : \beta 2_i . \hat{B}_{n-\tau 1,i})$.

The voice activity detector 15 of FIG. 2 comprises a module 19 which calculates energies of the denoised versions of the signal $\hat{E}p_{1,n,i}$ and $\hat{E}p_{2,n,i}$ respectively lying in m frequency bands designated by the index j ($1 \leqq j \leqq m$, $m \geqq 1$). This resolution may be the same as that of the subbands defined by the module 12 (index i), or a finer resolution of possibly as much as the whole of the useful band $[0, F_e/2]$ of the signal (case m=1). By way of example, the module 12 can define I=16 uniform subbands of the band $[0, F_e/2]$, and the module 19 can retain m=3 wider bands, each band of index j covering the subbands of index i ranging from imin(j) to imax(j), with imin(1)=1, imin(j+1)=imax(j)+1 for $1 \leqq j < m$, and imax(m)=1. In step 190 (FIG. 3), the module 19 calculates the energies per band:

$$E_{l,n,j} = \sum_{i=\mathrm{imin}(j)}^{\mathrm{imax}(j)} [f(i) - f(i-1)] \cdot \hat{E}p_{l,n,i}^2$$

$$E_{2,n,j} = \sum_{i=\mathrm{imin}(j)}^{\mathrm{imax}(j)} [f(i) - f(i-1)] \cdot \hat{E}p_{2,n,i}^2$$

A module 20 of the voice activity detector 15 performs a temporal smoothing of the energies $E_{1,n,j}$ and $E_{2,n,j}$ for each of the bands of index j, this corresponding to steps 200 to 205 for FIG. 4. The smoothing of these two energies is performed by means of a determined smoothing window by comparing the energy $E_{2,n,j}$ of the most denoised version with its previously calculated smoothed energy $\bar{E}_{2,n-1,j}$, or with a value of the order of this smoothed energy $\bar{E}_{2,n-1,j}$, (tests 200 and 201). This smoothing window can be an exponential window defined by a forget factor $\lambda$ lying between 0 and 1. This forget factor $\lambda$ can take three values: the one $\lambda_r$ very close to 0 (for example $\lambda_r=0$) chosen in step 202 if $E_{2,n,j} \leqq \bar{E}_{2,n-1,j}$; the second $\lambda_q$ very close to 1 (for example $\lambda_q=0.99999$) chosen in step 203 if $E_{2,n,j} > \Delta \bar{E}_{2,n-1,j}$, $\Delta$ being a coefficient bigger than 1; and the third $\lambda_p$ lying between 0 and $\lambda_q$ (for example $\lambda_p=0.98$) chosen in step 204 if $\bar{E}_{2,n-1,j} < E_{2,n-1,j} \leqq \Delta \bar{E}_{2,n-1,j}$. The exponential smoothing with the forget factor $\lambda$ is then performed conventionally in step 205 according to:

$$\bar{E}_{1,n,j} = \lambda . \bar{E}_{1,n-1,j} + (1-\lambda) . E_{1,n,j}$$

$$\bar{E}_{2,n,j} = \lambda . \bar{E}_{2,n-1,j} + (1-\lambda) . E_{2,n,j}$$

Figure 5:
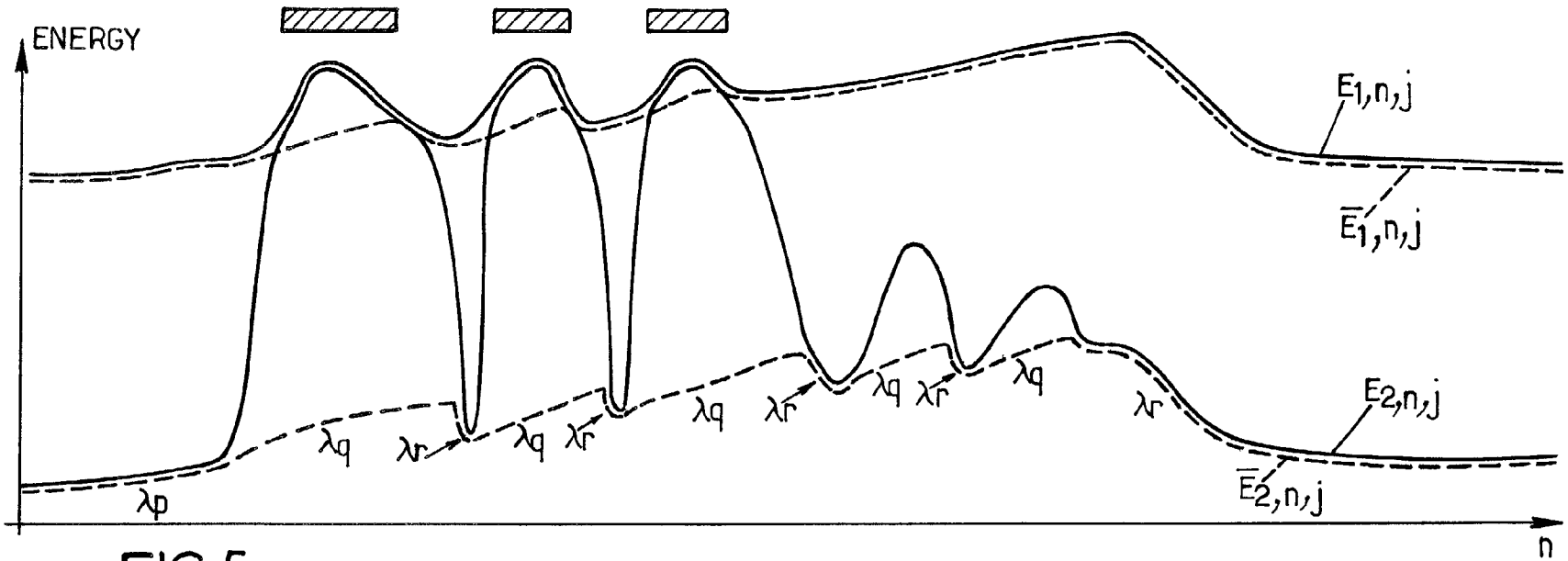
FIG. 5 is a graphic showing an exemplary profile of energies calculated in the detector of FIG. 2 and illustrating the principle of voice activity detection.

An exemplary variation over time of the energies $E_{1,n,j}$ and $E_{2,n,j}$ and of the smoothed energies $\bar{E}_{1,n,j}$, and $\bar{E}_{2,n,j}$ is represented in FIG. 5. It may be seen that good tracking of the smoothed energies is achieved when the forget factor is determined on the basis of the variations in the energy $E_{2,n,j}$ corresponding to the most denoised version of the signal. The forget factor $\lambda_p$ makes it possible to take into account the increases in the level of the background noise, the energy reductions being tracked by the forget factor $\lambda_r$. The forget factor $\lambda_q$ very close to 1 means that the smoothed energies do not track the abrupt energy increases due to speech. However, the factor $\lambda_q$ remains slightly less than 1 so as to avoid errors caused by an increase in the background noise which may arise during a fairly long period of speech.

The voice activity detection automaton is controlled in particular by a parameter resulting from a comparison of the energies $E_{1,n,j}$ and $E_{2,n,j}$. This parameter can in particular be the ratio $d_{n,j}=E_{1,n,j}/E_{2,n,j}$. It may be seen in FIG. 5 that this ratio $d_{n,j}$ allows proper detection of the speech phases (represented by hatching).

The control of the detection automaton can also use other parameters, such as a parameter related to the signal-to-noise ratio: $snr_{n,j}=E_{1,n,j}/\bar{E}_{1,n,j}$, this amounting to taking into account a comparison between the energies $E_{1,n,j}$ and $\bar{E}_{1,n,j}$. The module 21 for controlling the automata relating to the various bands of index j calculates the parameters $d_{n,j}$ and $snr_{n,j}$ in step 210, then determines the state of the automata. The new state $\delta_{n,j}$ of the automaton relating to band j depends on the previous state $\delta_{n-1,j}$, on $d_{n,j}$ and on $snr_{n,j}$, for example as indicated in the diagram of FIG. 6.

Four states are possible: $\delta_j=0$ detects silence, or absence of speech; $\delta_j=2$ detects the presence of voice activity; and the states $\delta_j=1$ and $\delta_j=3$ are intermediate states of ascent and descent. When the automaton is in the silence state ($\delta_{n-1,j}=0$), it remains there if $d_{n,j}$ exceeds a first threshold $\alpha 1_j$, and if it switches to the ascent state in the converse case. In the ascent state ($\delta_{n-1,j}=1$), it returns to the silence state if $d_{n,j}$ exceeds a second threshold $\alpha 2_j$; and it switches to the speech state in the converse case. When the automaton is in the speech state ($\delta_{n-1,j}=2$), it remains there if $snr_{n,j}$ exceeds a third threshold $\alpha 3_j$, and it switches to the descent state in the converse case. In the descent state ($\delta_{n-1,j}=3$), the automaton returns to the speech state if $snr_{n,j}$ exceeds a fourth threshold $\alpha 4_j$, and it returns to the silence state in the converse case. The thresholds $\alpha 1_j$, $\alpha 2_j$, $\alpha 3_j$, and $\alpha 4_j$ may be optimized separately for each of the frequency bands j.

It is also possible for the automata relating to the various bands to be made to interact by the module 21.

In particular, it may force each of the automata relating to each of the subbands to the speech state as soon as one among them is in the speech state. In this case, the output of the voice activity detector 15 relates to the whole of the signal band.

The two appendices to the present description show a source code in the C++ language, with a fixed-point data representation corresponding to an implementation of the exemplary voice activity detection method described hereinabove. To embody the detector, one possibility is to translate this source code into executable code, to record it in a program memory associated with an appropriate signal processor, and to have it executed by this processor on the input signals of the detector. The function a_priori_signal_power presented in appendix 1 corresponds to the operations incumbent on the modules 18 and 19 of the voice activity detector 15 of FIG. 2. The function voice_activity_detector presented in appendix 2 corresponds to the operations incumbent on the modules 20 and 21 of this detector.

In the particular example of the appendices, the following parameters have been employed: $\tau 1=1$; $\tau 2=0$; $\beta 1_i=0.3$; $\beta 2_i=0.001$; m=3; $\Delta=4.953$; $\lambda_p=0.98$; $\lambda_q=0.99999$; $\lambda_r=0$; $\alpha 1_j=\alpha 2_j=\alpha 4_j=1.221$; $\alpha 3_j=1.649$. Table 1 hereinbelow gives the correspondences between the notation employed in the above description and in the drawings and that employed in the appendix.

TABLE I

| | |
|---|---|
| subband | I |
| E[subband] | $S_{n,i}$ |
| module | $\hat{E}p_{n,i}$ or $\hat{E}p_{1,n,i}$ or $\hat{E}p_{2,n,i}$ |
| param.beta_a_priori1 | $\beta 1_j$ |
| param.beta_a_priori2 | $\beta 2_j$ |
| vad | j-1 |
| param.vad_number | m |
| P1[vad] | $E_{1,n,j-1}$ |
| P1s[vad] | $\bar{E}_{1,n,j-1}$ |
| P2[vad] | $E_{2,n,j-1}$ |
| P2s[vad] | $\bar{E}_{2,n,j-1}$ |
| DELTA_P | $Log(\Delta)$ |
| d | $Log(d_{n,j})$ |
| snr | $Log(snr_{n,j})$ |
| NOISE | silence state |
| ASCENT | ascent state |
| SIGNAL | speech state |
| DESCENT | descent state |
| D_NOISE | $Log(\alpha 1_j)$ |
| D_SIGNAL | $Log(\alpha 2_j)$ |
| SNR_SIGNAL | $LOG(\alpha 3_j)$ |
| SNR_NOISE | $Log(\alpha 4_j)$ |

In the variant embodiment illustrated by FIG. 7, the denoising module 25 of the voice activity detector 15 delivers a single denoised version $\hat{E}p_{n,i}$ of the speech signal, so that the module 26 calculates its energy $E_{2,n,j}$ for each band j. The other version, in which the module 26 calculates the energy, is represented directly by the non-denoised samples $S_{n,i}$.

As before, various denoising processes may be applied by the module 25. In the example illustrated by steps 250 to 256 of FIG. 8, the denoising is done by nonlinear spectral subtraction with a noise overestimation coefficient dependent on a quantity ρ related to the signal-to-noise ratio. In steps 250 to 252, a preliminary denoising is performed for each subband of index i according to:

$$S'_{n,i}=\max(S_{n,i}-\alpha.\hat{B}_{n-1,i};\beta.\hat{B}_{n-1,i})$$

the preliminary overestimation coefficient being for example $\alpha=2$, and the fraction β possibly corresponding to a noise attenuation of the order of 10 dB.

The quantity ρ is taken equal to the ratio $S'_{n,i}/S_{n,i}$ in step 253. The overestimation factor f(ρ) varies in a nonlinear manner with the quantity ρ, for example as represented in FIG. 9. For the values of ρ closest to 0 ($\rho<\rho_1$), the signal-to-noise ratio is low, and it is possible to take an overestimation factor f(ρ)=2. For the highest values of ρ ($\rho_2\leqq\rho\leqq 1$), the noise is weak and need not be overestimated (f(ρ)=1). Between $\rho_1$ and $\rho_2$, f(ρ) decreases from 2 to 1, for example linearly. The denoising proper, providing the version $\hat{E}p_{n,i}$ is performed in steps 254 to 256:

$$\hat{E}p_{n,i}=\max(S_{n,i}-f(\rho).\hat{B}_{n-1,i};\beta.\hat{B}_{n-1,i})$$

The voice activity detector 15 considered with reference to FIG. 7 uses, in each frequency band of index j (and/or in full band), a detection automaton having two states, silence or speech. The energies $E_{1,n,j}$ and $E_{2,n,j}$ calculated by the module 26 are respectively those contained in the components $S_{n,i}$ of the speech signal and those contained in the denoised components $\hat{E}p_{n,i}$ calculated over the various bands as indicated in step 260 of FIG. 8. The comparison of the two different versions of the speech signal pertains to respective differences between the energies $E_{1,n,j}$ and $E_{2,n,j}$ and a lower bound of the energy $E_{2,n,j}$ of the denoised version.

This lower bound $E_{2min,j}$ can in particular correspond to a minimum value, over a sliding window, of the energy $E_{2,n,j}$ of the denoised version of the speech signal in the frequency band considered. In this case, a module 27 stores in a memory of the first-in first-out type (FIFO) the L most recent values of the energy $E_{2,n,j}$ of the denoised signal in each band j, over a sliding window representing for example of the order of 20 frames, and delivers the minimum energies $$E_{2\min,j} = \min_{0 \le k < L} E_{2,n-k,j}$$

over this window (step 270 of FIG. 8). In each band, this minimum energy $E_{2min,j}$ serves as lower bound for the module 28 for controlling the detection automaton, which uses a measure $M_j$ given by $$M_j = \frac{E_{2,n,j} - E_{2\min,i}}{E_{2,n,j} - E_{2\min,j}}. \quad \text{(step 280)}$$

The automaton can be a simple binary automaton using a threshold $A_j$, possibly dependent on the band considered: If $M_j \geqq A_j$, the output bit $\delta_{n,j}$ of the detector represents a silence state of the band j, and if $M_j \leqq A_j$, it represents a speech state. As a variant, the module 28 could deliver a nonbinary measure of the voice activity, represented by a decreasing function of $M_j$.

As a variant, the lower bound $E_{2min,j}$ used in step 280 could be calculated with the aid of an exponential window, with a forget factor. It could also be represented by the energy over band j of the quantity $\beta.\hat{B}_{n-1,i}$ serving as floor in the denoising by spectral subtraction.

In the foregoing, the analysis performed in order to decide on the presence or absence of voice activity pertains directly to energies of different versions of the speech signal. Of course, the comparisons could pertain to a monotonic function of these energies, for example a logarithm, or to a quantity having similar behavior to the energies according to voice activity (for example the power).

APPENDIX 1

```
/*****************************************************************
******
* description
* -----------
* NSS module:
* signal power before VAD
*
*****************************************************************
******/
/*-----------------------------------------------------------
-----*
*                                        included files
*-----------------------------------------------------------
-----*/
#include <assert.h>
#include "private.h"
/*-----------------------------------------------------------
-----*
*                                        private
*-----------------------------------------------------------
-----*/
Word32 power(Word16 module, Word16 beta, Word16 thd, Word16 val);
/*-----------------------------------------------------------
-----*
*                                a_priori_signal_power
*-----------------------------------------------------------
-----*/
void a_priori_signal_power
(
/* IN */          Word16 *E, Word16 *internal_state, Word16 *max_noise,
Word16 *long_term_noise,
                 Word16 *frequential_scale,
/* IN&OUT */     Word16 *alpha,
/* OUT */        Word32 *P1, Word32 *P2
)
{
    int vad;
    for(vad = 0; vad < param.vad_number; vad++) {
        int start = param.vads[vad].first_subband_for_power;
        int stop = param.vads[vad].last_subband;
        int subband;
        int uniform_subband;
        uniform_subband = 1;
        for(subband = start; subband <= stop; subband++)
            if(param.subband_size[subband] != param.subband_size[start]
)
                uniform_subband = 0;
        P1[vad] = 0; move32();
        P2[vad] = 0; move32();
        test(); if(sub(internal_state[vad], NOISE) == 0) {
```

-continued

APPENDIX 1

```
                for(subband = start; subband <= stop; subband++) {
                        Word32 pwr;
                        Word16 shift;
                        Word16 module;
                        Word16 alpha_long_term;
                        alpha_long_term = shr(max_noise[subband], 2); move16();
                        test(); test(); if(sub(alpha_long_term, long_term_noise
[subband]) >= 0) {
                                alpha[subband] = 0x7fff; move16();
                                alpha_long_term = long_term_noise[subband]; move16();
                        } else if(sub(max_noise[subband], long_term_noise[subban
d]) < 0) {
                                alpha[subband] = 0x2000; move16();
                                alpha_long_term = shr(long_term_noise[subband],2); move
16();
                        } else {
                                alpha[subband] = div_s(alpha_long_term, long_term_noise
[subband]); move16();
                        }
                        module = sub(E[subband], shl(alpha_long_term, 2)); move
16();
                        if(uniform_subband) {
                                shift = shl(frequential_scale[subband], 1); move16();
                        } else {
                                shift = add(param.subband_shift[subband], shl(frequen
tial_scale[subband], 1)); move16();
                        }
                        pwr = power(module, param.beta_a_priori1, long_term_noise
[subband], long_term_noise[subband]);
                        pwr = L_shr(pwr, shift);
                        P1[vad] = L_add(P1[vad], pwr); move32();
                        pwr = power(module, param.beta_a_priori2, long_term_noise
[subband], long_term_noise[subband]);
                        pwr = L_shr(pwr, shift);
                        P2[vad] = L_add(P2[vad], pwr); move32();
                }
        } else {
                for(subband = start; subband <= stop; subband++) {
                        Word32 pwr;
                        Word16 shift;
                        Word16 module;
                        Word16 alpha_long_term;
                        alpha_long_term = mult(alpha[subband], long_term_noise
[subband]); move16();
                        module = sub{E[subband], shl(alpha_long_term, 2}); move
16();
                        if(uniform_subband) {
                                shift = sh1(frequential_scale[subband], 1); move16();
                        } else {
                                shift = add(param.subband_shift[subband], sh1(frequen
tial_scale[subband], 1)); move16();
                        }
                        pwr = power(module, param.beta_a_priori1, long_term_noise
[subband], E[subband]);
                        pwr = L_shr(pwr, shift);
                        P1[vad] = L_add(P1[vad], pwr); move32();
                        pwr = power(module, param.beta_a_priori2, long_term_noise
[subband], E[subband]);
                        pwr = L_shr(pwr, shift);
                        P2[vad] = L_add(P2[vad], pwr); move32();
                }
        }
    }
}
/*-----------------------------------------------------------------
-----*
*                                                        power
*-----------------------------------------------------------------
-----*/
Word32 power(Word16 module, Word16 beta, Word16 thd, Word16 val)
{
    Word32 power;
    test(); if(sub(module, mult(beta, thd)) <= 0) {
        Word16 hi, lo;
        power = L_mult(val, val); move32();
        L_Extract(power, &hi, &lo);
        power = Mpy_32_16(hi, lo, beta); move32();
```

-continued

APPENDIX 1

```
        L_Extract(power, &hi, &lo);
        power = Mpy_32_16(hi, lo, beta); move32();
    } else {
        power = L_mult(module, module); move32();
    }
    return(power);
}
```

APPENDIX 2

```
/*****************************************************************
******
* description
* -----------
* NSS module:
* VAD
*
*****************************************************************
******/
/*-----------------------------------------------------------------
-----*
*                                        included files
*-----------------------------------------------------------------
-----*/
#include <assert.h>
#include "private-h"
#include "simutool.h"
/*-----------------------------------------------------------------
-----*
*                                                  private
*-----------------------------------------------------------------
-----*/
#define DELTA_P          (1.6 * 1024)
#define D_NOISE          (.2 * 1024)
#define D_SIGNAL         (.2 * 1024)
#define SNR_SIGNAL       (.5 * 1024)
#define SNR_NOISE        (.2 * 1024)
/*-----------------------------------------------------------------
-----*
*                                    voice_activity_detector
/*-----------------------------------------------------------------
-----*/
void voice_activity_detector
{
/* IN */          Word32 *P1, Word32 *P2, Word16 frame_counter,
/* IN&OUT */      Word32 *P1s, Word32 *P2s, Word16 *internal_state,
/* OUT */         Word16 *state
}
{
    int vad;
    int signal;
    int noise;
    signal = 0; move16();
    noise = 1; move16();
    for(vad = 0; vad < param.vad_number; vad++) {
        Word16 snr, d;
        Word16 logP1, logP1s;
        Word16 logP2, logP2s;
        logP2 = logfix(P2[vad]); move16();
        logP2s = logfix(P2s[vad]); move16();
        test(); if(L_sub(P2[vad], P2s[vad]) > 0) {
            Word16 hi1, lo1;
            Word16 hi2, lo2;
            L_Extract(L_sub(P1[vad], P1s[vad]), &hi1, &lo1);
            L_Extract(L_sub(P2[vad], P2s[vad]), &hi2, &lo2);
            test(); if(sub(sub{logP2, logP2s}, DELTA_P) < 0) {
                P1s[vad] = L_add(P1s[vad], L_shr(Mpy_32_16(hi1, lo1, 0×6
666), 4)); move32();
                P2s[vad] = L_add(P2s[vad], L_shr(Mpy_32_16(hi2, lo2, 0×6
666), 4)); move32();
            } else {
                P1s[vad] = L_add(P1s[vad], L_shr(Mpy_32_16(hi1, lo1, 0×6
8db), 13)); move32();
```

-continued

APPENDIX 2

```
                P2s[vad] = L_add(P2s[vad], L_shr(Mpy_32_16(hi2, lo2, 0×6
8db), 13)); move32();
            }
        } else {
            P1s[vad] = P1[vad]; move32();
            P2s[vad] = P2[vad]; move32();
        }
        logP1 = logfix(P1[vad]); move16();
        logP1s = logfix(P1s[vad]); move16();
        d = sub(logP1, logP2); move16();
        snr = sub(logP1, logP1s); move16();
        ProbeFix16("d", &d, 1, 1.);
        ProbeFix16("_snr", &snr, 1, 1.);
{
    Word16 pp;
    ProbeFix16("p1", &logP1, 1, 1.);
    ProbeFix16("p2", &logP2, 1, 1.);
    ProbeFix16("p1s", &logP1s, 1, 1.);
    ProbeFix16("p2s", &logP2s, 1, 1.);
    pp = logP2 - logP2s;
    ProbeFix16("dp", &pp, 1, 1.);
}
    test(); if(sub(internal_state[vad], NOISE) == 0)
        goto LABEL_NOISE;
    test(); if(sub(internal_state[vad], ASCENT) == 0)
        goto LABEL_ASCENT;
    test(); if(sub(internal_state[vad], SIGNAL) == 0)
        goto LABEL_SIGNAL;
    test(); if(sub(internal_state[vad], DESCENT) == 0)
        goto LABEL_DESCENT;
    LABEL_NOISE:
    test(); if(sub(d, D_NOISE) < 0) {
        internal_state[vad] = ASCENT; move16();
    }
    goto LABEL_END_VAD;
    LABEL_ASCENT:
    test(); if(sub(d, D_SIGNAL) < 0) {
        internal_state[vad] = SIGNAL; move16();
        signal = 1; move16();
        noise = 0; move16();
    } else {
        internal_state[vad] = NOISE; move16();
    }
    goto LABEL_END_VAD;
    LABEL_SIGNAL:
    test(); if(sub(snr, SNR_SIGNAL) < 0) {
        internal_state[vad] = DESCENT; move16();
    } else {
        signal = 1; move16();
    }
    noise = 0; move16();
    goto LABEL_END_VAD;
    LABEL_DESCENT:
    test(); if(sub(snr, SNR_NOISE) < 0) {
        internal_state[vad] = NOISE; move16();
    } else {
        internal_state[vad] = SIGNAL; move16();
        signal = 1; move16();
        noise = 0; move16();
    }
    goto LABEL_END_VAD;
    LABEL_END_VAD:
    ;
}
*state = TRANSITION; move16();
test(); test(); if(signal != 0) {
    test(); if(sub(frame_counter, param.init_frame_number) >= 0) {
        for(vad = 0; vad < param.vad_number; vad++) {
            internal_state[vad] = SIGNAL; move16();
        }
        *state = SIGNAL; move16();
    }
    } else if(noise != 0) {
        *state = NOISE; move16();
    }
}
```

The invention claimed is:

1. Method for detecting voice activity in a digital speech signal in at least one frequency band, wherein the voice activity is detected on the basis of an analysis comprising the step of comparing two different versions of the speech signal, wherein the two different versions of the speech signal are two versions denoised by non-linear spectral subtraction, wherein a first of the two versions is denoised in such a way as not to be less, in the spectral domain, than a first fraction of a long-term estimate representative of a noise component included in the speech signal, and the second of the two versions is denoised in such a way as not to be less, in the spectral domain, than a second fraction of said long-term estimate, smaller than said first fraction.

2. Method according to claim 1, wherein said comparison is performed on respective energies, evaluated in said frequency band, of the two different versions of the speech signal, or to a monotonic function of said energies.

3. Method according to claim 1, wherein said analysis further comprises a time smoothing of the energy of one of said versions of the speech signal, and a comparison between the energy of said version and the smoothed energy.

4. Method according to claim 3, wherein the comparison between the energy of said version and the smoothed energy controls transitions of a voice activity detection automaton from a speech state to a silence state, and wherein the comparison of the two different versions of the speech signal controls transitions of the detection automaton from the silence state to the speech state.

5. Method according to claim 1, wherein said analysis further comprises a time smoothing of the energy of each of the two versions of the speech signal, by means of a smoothing window determined by comparing the energy of the second of the two versions with the smoothed energy of the second of the two versions.

6. Method according to claim 5, wherein the smoothing window is an exponential window defined by a forgetting factor.

7. Method according to claim 6, comprising the step of allocating a substantially zero value to the forgetting factor when the energy of the second of the two versions is less than a value of the order of the smoothed energy of the second of the two versions.

8. Method according to claim 7, comprising the step of allocating a first value substantially equal to 1 to the forgetting factor when the energy of the second of the two versions is greater than said value of the order of the smoothed energy multiplied by a coefficient bigger than 1, and allocating a second value lying between 0 and said first value to the forgetting factor when the energy of the second of the two versions is greater than said value of the order of the smoothed energy and less than said value of the order of the smoothed energy multiplied by said coefficient.

9. Method according to claim 1, wherein the first and second fractions correspond substantially to attenuations of 10 dB and 60 dB, respectively.

10. Method according to claim 1, wherein the comparison of the two different versions of the speech signal is performed on respective differences between the energies of said two versions in said frequency band and a lower bound of the energy of the denoised version of the speech signal in said frequency band.

11. Device for detecting voice activity in a speech signal, comprising signal processing means for analyzing the speech signal in at least one frequency band, wherein the processing means comprise:

first non-linear spectral subtraction means to provide a first version of the speech signal as a denoised version which is not less, in the spectral domain, than a first fraction of a long-term estimate representative of a noise component included in the speech signal;

second non-linear spectral subtraction means to provide a second version of the speech signal as a denoised version which is not less, in the spectral domain, than a second fraction of said long-term estimate, said second fraction being smaller than said first fraction; and means for comparing the first and second versions of the speech signal.

12. Device according to claim 11, wherein the processing means comprise means for evaluating, in said frequency band, energies of said first and second versions of the speech signal, whereby inputs of the comparison means comprise said energies or a monotonic function of said energies.

13. Device according to claim 11, wherein the processing means further comprises means for performing a time smoothing of the energy of one of said first and second versions of the speech signal, and means for comparing the energy of said version and the smoothed energy.

14. Device according to claim 13, wherein the processing means comprise a voice activity detection automaton having a plurality of states including a speech state and a silence state, means for controlling transitions of the voice activity detection automaton from the speech state to the silence state based on a comparison between the energy of said one of said first and second versions and the smoothed energy, and means for controlling transitions of the voice activity detection automaton from the silence state to the speech state based on a comparison of the first and second versions of the speech signal.

15. Device according to claim 11, wherein the processing means further comprises means for performing a time smoothing of the energy of each of the first and second versions of the speech signal, by means of a smoothing window determined by comparing an energy of the second version with the smoothed energy of the second version.

16. Device according to claim 15, wherein the smoothing window is an exponential window defined by a forgetting factor.

17. Device according to claim 16, wherein the processing means further comprises means for allocating a substantially zero value to the forgetting factor when the energy of the second version is less than a value of the order of the smoothed energy of the second version.

18. Device according to claim 17, wherein the processing means further comprises means for allocating a first value substantially equal to 1 to the forgetting factor when the energy of the second version is greater than said value of the order of the smoothed energy multiplied by a coefficient bigger than 1, and for allocating a second value lying between 0 and said first value to the forgetting factor when the energy of the second version is greater than said value of the order of the smoothed energy and less than said value of the order of the smoothed energy multiplied by said coefficient.

19. Device according to claim 11, wherein the first and second fractions correspond substantially to attenuations of 10 dB and 60 dB, respectively.

20. Device according to claim 11, wherein the comparison of the first and second versions of the speech signal is performed on respective differences between the energies of said first and second versions in said frequency band and a lower bound of the energy of the denoised version of the speech signal in said frequency band.

21. A computer program product, loadable into a memory associated with a processor, and comprising portions of code for execution by the processor to detect voice activity in an input digital speech signal in at least one frequency band, whereby the voice activity is detected on the basis of an analysis comprising the step of comparing two different versions of the speech signal, wherein the two different versions of the speech signal are two versions denoised by non-linear spectral subtraction, wherein a first of the two versions is denoised in such a way as not to be less, in the spectral domain, than a first fraction of a long-term estimate representative of a noise component included in the speech signal, and the second of the two versions is denoised in such a way as not to be less, in the spectral domain, than a second fraction of said long-term estimate, smaller than said first fraction.

22. A computer program product according to claim 21, wherein said comparison is performed on respective energies, evaluated in said frequency band, of the two different versions of the speech signal, or to a monotonic function of said energies.

23. A computer program product according to claim 21, wherein said analysis further comprises a time smoothing of the energy of one of said versions of the speech signal, and a comparison between the energy of said version and the smoothed energy.

24. A computer program product according to claim 23, wherein the comparison between the energy of said version and the smoothed energy controls transitions of a voice activity detection automaton from a speech state to a silence state, and wherein the comparison of the two different versions of the speech signal controls transitions of the detection automaton from the silence state to the speech state.

25. A computer program product according to claim 21, wherein said analysis further comprises a time smoothing of the energy of each of the two versions of the speech signal, by means of a smoothing window determined by comparing the energy of the second of the two versions with the smoothed energy of the second of the two versions.

26. A computer program product according to claim 25, wherein the smoothing window is an exponential window defined by a forgetting factor.

27. A computer program product according to claim 26, wherein said analysis further comprises the step of allocating a substantially zero value to the forgetting factor when the energy of the second of the two versions is less than a value of the order of the smoothed energy of the second of the two versions.

28. A computer program product according to claim 27, wherein said analysis further comprises the steps of allocating a first value substantially equal to 1 to the forgetting factor when the energy of the second of the two versions is greater than said value of the order of the smoothed energy multiplied by a coefficient bigger than 1, and allocating a second value lying between 0 and said first value to the forgetting factor when the energy of the second of the two versions is greater than said value of the order of the smoothed energy and less than said value of the order of the smoothed energy multiplied by said coefficient.

29. A computer program product according to claim 21, wherein the first and second fractions correspond substantially to attenuations of 10 dB and 60 dB, respectively.

30. A computer program product according to claim 21, wherein the comparison of the two different versions of the speech signal is performed on respective differences between the energies of said two versions in said frequency band and a lower bound of the energy of the denoised version of the speech signal in said frequency band.

* * * * *